US005143121A

United States Patent [19]

Steinhardt et al.

[11] Patent Number: 5,143,121

[45] Date of Patent: Sep. 1, 1992

[54] FLUID PULSE GENERATING APPARATUS

[75] Inventors: Michael D. Steinhardt, Kiel; Kathleen S. DeKeyser, Hingham; Jeffrey F. Tempas, Oostburg, all of Wis.

[73] Assignee: Kohler Co., Kohler, Wis.

[21] Appl. No.: 790,272

[22] Filed: Nov. 8, 1991

[51] Int. Cl.[5] ..... F16K 11/074

[52] U.S. Cl. ..... 137/624.13; 137/625.11; 137/597

[58] Field of Search ..... 137/625.11, 624.13, 137/624.15, 597, 624.18; 251/160, 180

[56] References Cited

U.S. PATENT DOCUMENTS

| | | | |
|---|---|---|---|
| 2,477,590 | 8/1949 | Ferwerda | 137/624.13 X |
| 2,869,526 | 1/1959 | Dolza | 137/625.11 X |
| 3,092,664 | 9/1975 | Deines | 239/102 |
| 3,924,805 | 12/1975 | Nebeker et al. | 239/1 |
| 4,015,779 | 4/1977 | Kwok | 239/102 |
| 4,077,569 | 3/1978 | Deines | 239/101 |
| 4,177,927 | 12/1979 | Simmons | 239/101 |
| 4,819,009 | 4/1989 | Kniepkamp | 346/75 |
| 4,930,699 | 6/1990 | Wall | 239/102.1 |
| 5,014,748 | 5/1991 | Nogami et al. | 137/625.65 |

*Primary Examiner*—Alan Cohan

*Attorney, Agent, or Firm*—Quarles & Brady

[57] ABSTRACT

An apparatus for pulsing water flowing to a shower head includes a housing with a chamber, first and second water inlets to the chamber and a water outlet. The second inlet and the outlet are located through a wall of the housing at one end of the chamber. A valve has a plate with a plurality of apertures. The valve disposed within the chamber so that water flowing through the first inlet urges the valve into close proximity to the housing wall where rotational movement of the valve alternately opens and closes the water outlet. That action creates a pulsed flow of water through the outlet. Water flowing into the chamber through the second inlet moves the valve plate away from the housing wall permitting water to flow continuously from the second inlet into the outlet without being pulsed. A mechanism is coupled to the valve to produce the rotational movement.

10 Claims, 4 Drawing Sheets

FLUID PULSE GENERATING APPARATUS

BACKGROUND OF THE INVENTION

The present invention relates to devices for pulsating the flow of a fluid, such as water; and particularly to pulse generators for use with shower heads.

Water shower enclosures often have a shower head which can produce several different spray patterns as selected by the user. This type of shower head has a diverter mechanism that is manually operable to direct water from an inlet through separate flow paths to different groups of outlets which form the spray patterns. Typically one of the spray patterns is pulsed to create a massaging effect. A common way in which the pulsating pattern is produced uses a turbine valve located in a chamber of the associated water path. Water entering the chamber rotationally drives the turbine which has a plate that opens and closes outlets from the chamber as the turbine spins. The cyclical opening and closing of the outlets pulses the flow of water through them. The other flow paths bypass the turbine chamber so that the corresponding spray patterns are not pulsed.

A single shower enclosure may have multiple shower heads usually positioned at different heights to spray different parts of the user's body. Although it is possible to use self contained pulsating shower heads at each location within the shower enclosure, it is more cost effective to provide a single device for creating a pulsating flow which is applied to all the shower heads. Such a common pulsating mechanism is shown in U.S. Pat. No. 4,177,927 and includes a water driven valve mechanism for creating a pulsating flow at an outlet which communicates with several spray heads. However, this mechanism has a single flow path and can only produce a pulsed water flow.

SUMMARY OF THE INVENTION

An apparatus is operable to produce either a pulsed flow or a continuous flow of fluid through an outlet. The apparatus has a housing with a cylindrical chamber, first and second inlets through which fluid passes into the chamber and at least one outlet from the chamber. The second inlet and the outlet extend through a housing wall with defines the chamber.

A valve is located within the chamber and has a plate with a plurality of apertures therethrough. The valve is disposed within the chamber so that fluid flowing into the chamber through the first inlet urges the valve into a position at which the plate is in close proximity to the housing wall. Rotational movement of the apertured plate of the valve in this position, alternately opens and closes the fluid outlet creating a pulsed flow of fluid. Alternately fluid enters the chamber through the second inlet which forces the plate away from the housing wall into another position. This movement creates a passageway between the valve and the housing wall through which the fluid flows from the second inlet into the outlet without being pulsed.

A mechanism causes rotational movement of the valve in the first position. In the preferred embodiment of the present invention, a shaft is coupled to rotationally drive the valve while allowing movement of the valve along a longitudinal axis of the shaft. The shaft extends through an opening in the housing and is connected to an electric motor. A seal is provided to prevent the escape of fluid through the opening for the shaft.

The preferred embodiment has two outlets from the chamber. The apertures are arranged in the plate so that as one outlet is being opened the other outlet is being closed as the valve rotates in the first position. This arrangement insures that the combined flow of fluid through the outlets will be substantially constant, thereby preventing hammering in the plumbing system to which the apparatus is connected.

DETAILED DESCRIPTION OF THE INVENTION

Figure 1:
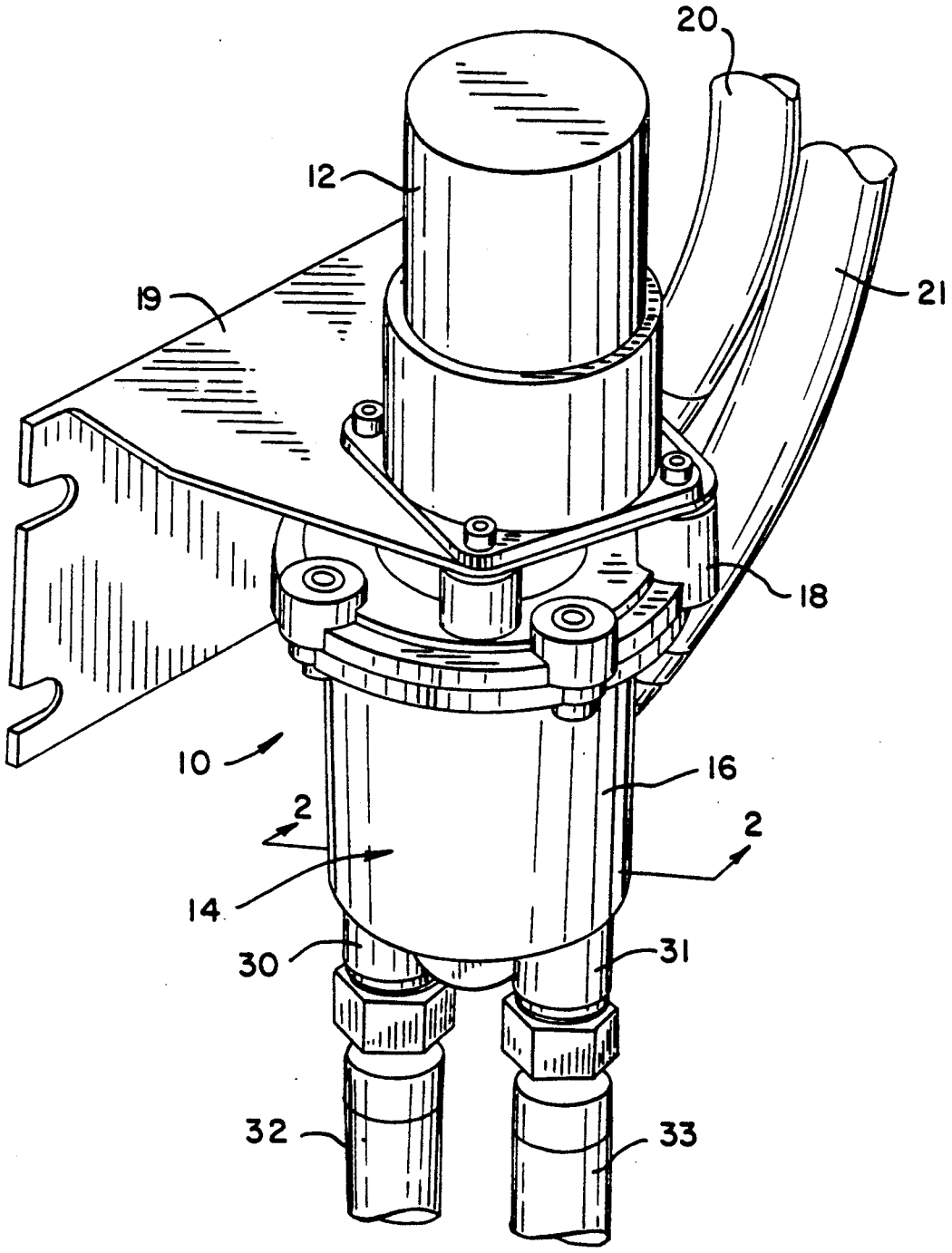
FIG. 1 illustrates a pictorial view of a fluid pulse generator according to the present invention.
Figure 2:
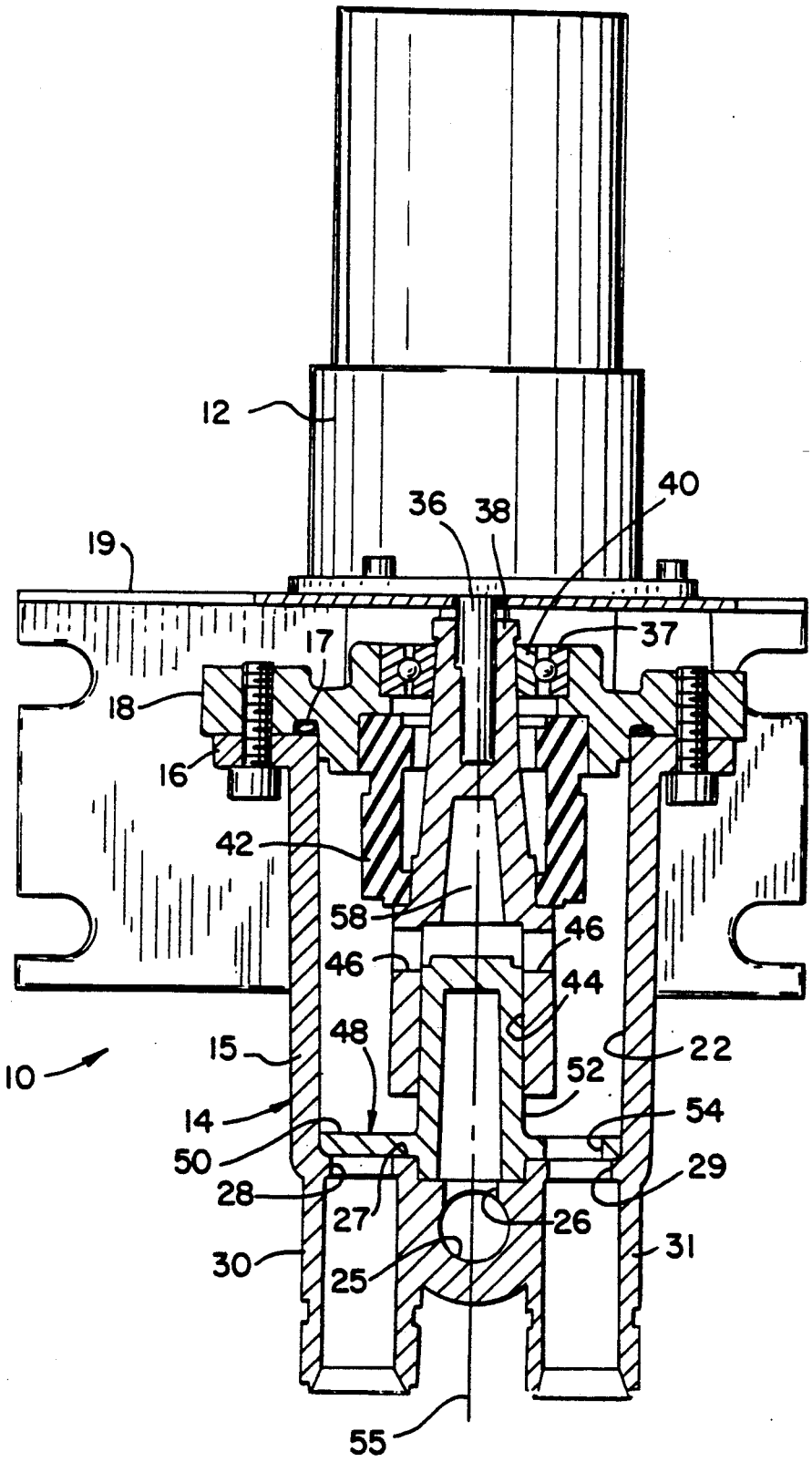
FIG. 2 is a longitudinal cross sectional through the fluid pulse generator.

FIGS. 1 and 2 illustrate a fluid pulse generator 10 that is adapted for use with a water shower enclosure for human hygiene. The fluid pulse generator 10 has a housing 14 with a hollow cylindrical body 15 that has one open end 16 across which a lid 18 is bolted to form a chamber 22. An O-ring 17 provides a fluid tight seal between the body and the lid. An electric motor 12 is bolted to the lid 18 with a mounting bracket 19 sandwiched between the motor 12 and the cover 18 for securing the pulse generator 10 to a vertical surface.

Water is supplied to the pulse generator 10 through a pair of supply hoses 20 and 21. Both supply hoses connect to the output of a mixing valve (not shown) that combines hot and cold water from a building plumbing system to produce water at the proper temperature desired by the user. A pair of solenoid valves (also not shown) are selectively energized to apply the water from the mixing valve to each of the supply hoses 20 and 21. Water is supplied to the pulse generator through one of the hoses 20 or 21 at a time. As will be described when water is supplied through the first supply hose 20, a pulsed water flow is produced at the output of the pulse generator 10, whereas a continuous flow is produced by supplying water through the second supply hose 21.

Figure 3:
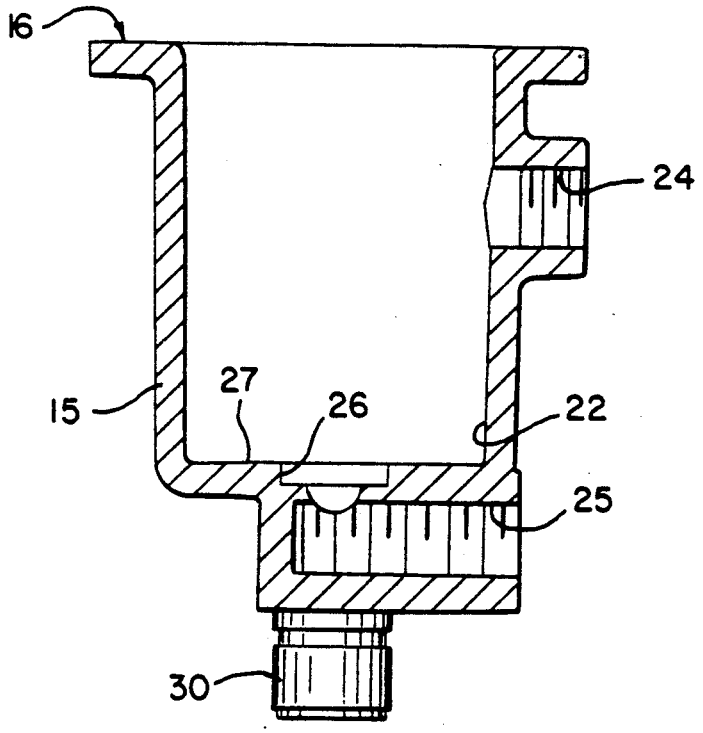
FIG. 3 is a cross sectional view of a pulse generator component which is rotated ninety degrees from its orientation in FIG. 2.

FIG. 3 depicts the details of the pulse generator body 15 and inner chamber 22. The first supply hose 20 connects to a first inlet 24 extending through a wall in the upper section of the body 15 and the second supply hose 21 connects to a second inlet 25 at the base of the body 15. The second inlet 21 is in communication with an opening 26 in the center of the bottom wall 27 of the circular chamber 22. Two outlets 28 and 29 also extend through the bottom wall 27 and are spaced approximately 180 degrees radially around the center opening 26, as shown in FIG. 2. The outlets 28 and 29 extend through separate tubular members 30 and 31 to which an output hose 32 and 33 respectively connects. Each of these output hoses extends from the pulse generator 10 to a separate spray nozzle in a shower enclosure (not shown).

With reference specifically to FIG. 2, when the fluid pulse generator 10 is assembled, a shaft 36 from motor 12 passes through an opening in the mounting bracket 19 and into an aperture in one end of a drive shaft 38. The drive shaft 38 extends through an opening 37 in the housing lid 18 and is mounted within a ball bearing 40. A seal 42 extends between the lid 18 and the drive shaft 38 to prevent fluid within chamber 22 from leaking therebetween. The end of the drive shaft 38 within the chamber 22 has an aperture 44 with a hexagonal cross section. A pair of vent holes 46 extend through the drive shaft 38 providing a path between aperture 44 and the exterior of the drive shaft.

Figure 4:
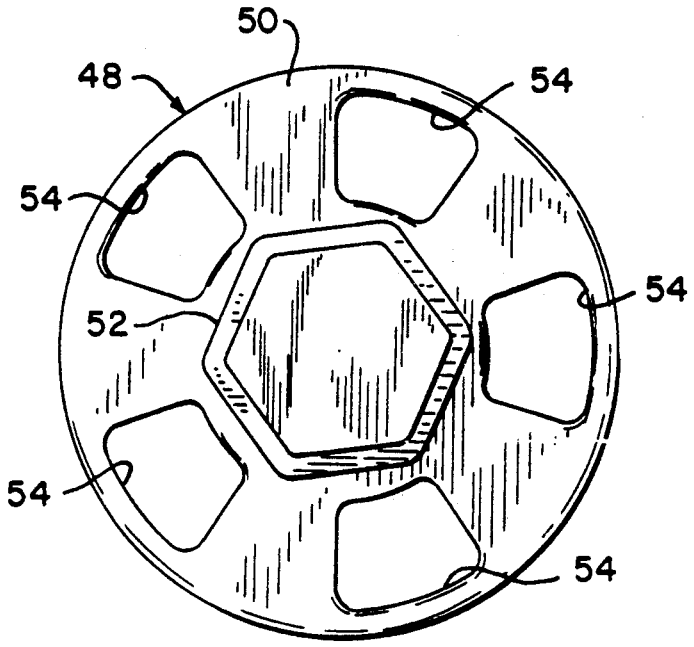
FIG. 4 is a top plane view of a rotary valve in the pulse generator.

Located within chamber 22 is a rotary valve 48 with a circular flat plate 50 and a hexagonal projection 52 extending from the plate, see also FIG. 4. The hexagonal projection 52 fits into the aperture 44 of the drive shaft 38 and is sized so that it cannot rotate within that aperture. As will be described, the rotary valve 48 revolves about axis 55 when the drive shaft 38 is driven by the motor 12. The fit of the hexagonal projection 52 of the rotary valve 48 within the aperture 44 of the drive shaft 38 allows the rotary valve to move along the drive shaft, up and down within the chamber 22.

Alternatively, the motor 12 could be eliminated by attaching turbine vanes to the drive shaft 38 so that water entering the chamber 22 through first inlet 24 strikes the vanes producing a rotational motion of the drive shaft.

With reference to FIGS. 2 and 4, the rotary valve 48 has five apertures 54 extending through the flat valving plate 50. Each aperture 54 has a cross sectional area approximately equal to the size of outlets 28 and 29 in the bottom wall 27 of the body 15. As the rotary valve spins within the chamber 22 about axis 55, the apertures 54 sequentially pass over the outlets 28 and 29. When an aperture 54 is not over an outlet, a solid portion of the plate 50 covers the outlet blocking the flow of water from the chamber 22. Because the five apertures 54 are equidistantly spaced around the projection 52, when one of the apertures 54 is aligned with an outlet 28 or 29, a solid portion of the plate is covering the other outlet. Thus, water flows through only one of the outlets in this position.

The fluid pulse generator 10 can be operated to provide either a pulsating or a continuous fluid flow through the outlets 28 and 29. The type of flow is chosen by the user placing a selector switch in the appropriate position to energize one of the solenoid valves. To create a pulsed flow, the selector switch energizes the solenoid valve connected to the first supply hose 20 furnishing water to the pulse generator 10 through the first inlet 24, while the solenoid valve for the second supply hose 21 is maintained closed. The activation of the selector switch for a pulsed flow also energizes the motor 12. With the motor energized, its shaft 36 begins to rotate at a speed between four and thirty revolutions per minute as selectable by the user This in turn causes the drive shaft 38 and the rotary valve 48 to spin within chamber 22 about axis 55.

In this state of operation, water enters the upper portion of the chamber 22 through the first inlet 24. This flow of water pushes the rotary valve 48 downward so that plate 50 is in close proximity to the inner surface of bottom wall 27 of the generator body 15. As the rotary valve 48 spins in this position, the apertures 54 and the solid portions of the plate 50 sequentially open and close the two outlets 28 and 29. This action sends bursts of water alternately through the two outlets and the associated hoses 32 and 33. The spray heads (not shown) connected to the other ends of the two output hoses 32 and 33 emit a pulsating spray or stream of water.

As can be seen from the position of the apertures 54 on the plate 50 shown in FIG. 4, when an aperture 54 is aligned with one of the outlets, for example first outlet 28, a solid portion of the plate 50 entirely covers the other outlet 29. Thus water flows out o chamber 22 through only the first outlet. As the rotary valve 48 continues to spin within the chamber, a solid portion of the plate 50 begins to cover the previously opened first outlet 28 and another aperture 54 moves over the second outlet 29. The first outlet 28 is being closed in proportion to the opening of the second outlet 29 until the second outlet is fully open and the first outlet is completely closed. The opposite action then occurs as the second outlet 29 is closed and the first outlet 28 is opened again by another aperture 54. The total flow of water through the outlets of the pulse generator 10 remains substantially constant throughout the entire cycle of the rotary valve. This action prevents a rapid alternation of the water flow which could cause hammering in the plumbing system.

Figure 5:
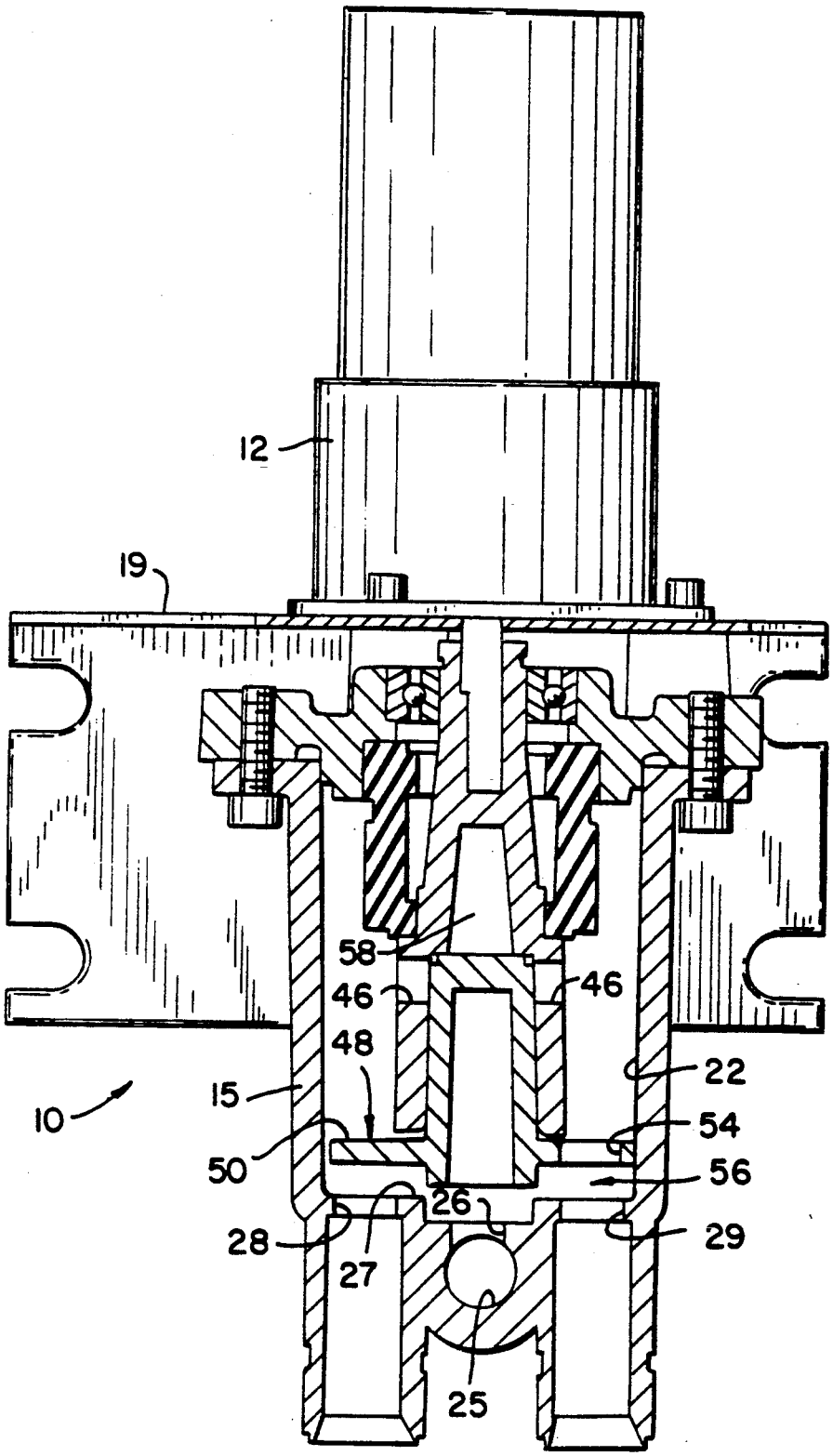
FIG. 5 is a cross sectional view of the fluid pulse generator in a different mode of operation.

To produce a continuous flow of water from the pulse generator 10, the user places the selector switch in a position that opens the solenoid valve attached to the second supply hose 21 while maintaining the solenoid attached to the first supply hose 20 in a closed state. Typically, the electric motor 12 is deenergized when water enters the chamber 22 from the second supply hose 21 through second inlet 25. The water, flowing through the second inlet 25 and aperture 26 in the bottom wall of the body 15, pushes upward against the underside of valve plate 50. Since water is not being admitted into the upper portion of the chamber 22 through the first inlet 24, the pressure of the flow of water against the underside of the rotating valve 48 moves the valve upward and further into the drive shaft 38 as shown in FIG. 5. Water within the upper portion 58 of the drive shaft aperture 44 is forced out of the vent holes 46 by this action. Water also flows through the apertures 54 in plate 50 allowing the rotating valve 48 to rise within chamber 22. This action raises the rotating valve 48 away from the bottom wall 27 creating a passageway 56 between the rotating valve 48 and that wall. The water entering the chamber 22 from the second inlet 25 flows through the newly formed passage directly to both outlets 28 and 29. The water flow is unaffected by the rotary valve 48 in the upward position and flows continuously through both outlets 28 and 29 without being pulsed.

The invention being claimed is:

1. An apparatus for producing a pulsated flow of a fluid comprising:

a housing with a chamber, a first fluid inlet, a second fluid inlet at one end of the chamber, and a fluid outlet through a wall at the one end of the chamber;

a rotary valve disposed within the chamber and having a means which alternately opens and closes the fluid outlet as said valve rotates, and disposed so that fluid flowing into the chamber from the first fluid inlet produces movement of the valve toward the wall at the one end of the chamber whereas fluid flowing into the chamber from the second fluid inlet produces movement of the valve away from the wall; and means for producing rotational movement of said valve.

2. The apparatus as recited in claim 1 wherein said means for producing rotational movement comprises an electric motor having a shaft coupled to said valve.

3. The apparatus as recited in claim 1 wherein said means for producing rotational movement comprises:

a drive shaft mechanically coupled to said valve in a manner that allows movement of said valve along said drive shaft and rotation movement of said drive shaft rotates said valve; and an electric motor connected to said drive shaft to produce the rotational movement.

4. The apparatus as recited in claim 1 wherein the means of said valve which alternately opens and closes the fluid outlet comprises a plate having a plurality of apertures therethrough that align with the outlet as said valve rotates.

5. The apparatus as recited in claim 1 wherein the movement of the valve away from the wall creates a passageway therebetween through which fluid can flow from the second inlet to the outlet.

6. A plumbing apparatus comprising:

a housing having a cylindrical chamber, a first inlet, a second inlet at one end of the chamber, and first and second fluid outlets through a housing wall at the one end of the chamber;

a valve having a circular plate with a plurality of apertures therethrough, said valve disposed within the chamber so that fluid flowing into the chamber through the first inlet urges said valve into a first position at which the plate is in close proximity to the housing wall where rotational movement of the valve alternately opens and closes each fluid outlet creating a pulsed flow of fluid through the outlets, and disposed so that fluid flowing into the chamber through the second inlet moves the plate away from the housing wall into a second position where fluid flows from the second inlet into the outlets without being pulsed;

a drive shaft coupled to rotationally drive said valve while allowing movement of said valve along a longitudinal axis of said drive shaft; and means for producing rotational movement of said drive shaft.

7. The apparatus as recited in claim 6 wherein said drive shaft extends through a wall of said housing; and means for producing rotational movement comprises an electric motor connected to said drive shaft.

8. The apparatus as recited in claim 6 wherein said drive shaft has an aperture a one end; and said valve has a projection extending from the plate into the aperture in said drive shaft.

9. The apparatus as recited in claim 6 wherein the plurality of apertures in said valve are located in the plate so that as the valve rotates in the first position within the chamber one fluid outlet is being opened as the other fluid outlet is being closed.

10. The apparatus as recited in claim 8 wherein the valve when operated in the first position maintains a substantially constant total flow of water through the two outlets.

* * * * *